United States Patent [19]

Kast

[11] Patent Number: 4,510,848

[45] Date of Patent: Apr. 16, 1985

[54] SHEAR-TYPE FAIL-FIXED SERVOVALVE

[75] Inventor: Howard B. Kast, Fairfield, Ohio

[73] Assignee: General Electric Company, Cincinnati, Ohio

[21] Appl. No.: 431,433

[22] Filed: Sep. 30, 1982

[51] Int. Cl.[3] ..... F15B 13/043

[52] U.S. Cl. ..... 91/461; 91/3; 137/625.25; 137/625.63; 137/625.64

[58] Field of Search ..... 91/3, 461; 137/83, 625.25, 137/625.61, 625.62, 625.63, 625.64

[56] References Cited

U.S. PATENT DOCUMENTS

| | | | |
|---|---|---|---|
| 2,047,922 | 7/1936 | Seligmann | 137/83 |
| 2,498,284 | 2/1950 | Leonard | 137/83 |
| 2,768,637 | 10/1956 | Sweeney | 137/83 |
| 2,936,783 | 5/1960 | Moffatt | 137/625.62 |
| 3,012,579 | 12/1961 | Meulendyk | 137/625.62 |
| 3,081,787 | 3/1963 | Meulendyk | 137/83 |
| 3,587,647 | 6/1971 | Walters | 137/625.25 |
| 3,922,955 | 12/1975 | Kast | 91/461 |
| 3,959,024 | 5/1976 | Kirk et al. | 137/625.25 |
| 4,227,443 | 10/1980 | Toot | 91/459 |

FOREIGN PATENT DOCUMENTS

| | | | |
|---|---|---|---|
| 1150454 | 1/1958 | France | 137/625.63 |

*Primary Examiner*—Gerald A. Michalsky

*Attorney, Agent, or Firm*—Gregory A. Welte; Derek P. Lawrence

[57] ABSTRACT

A shear-type, fail-fixed servovalve is disclosed which includes a piston whose piston head is movably disposed in one chamber of a multi-chamber housing. A piston rod is attached to the piston head and extends into the other chambers. Two passages extend through the piston rod and communicate with the chamber on opposite sides of the piston head. A pair of input orifices are located proximate each other at one end of the piston rod, each corresponding to one passage. An angularly movable jet pipe emits fluid directed at the input orifices. The jet pipe has a null angular position disposed at a predetermined offset angle with respect to the axis of the piston rod, and directs fluid towards the pair of orifices. Means responsive to a selectively variable control signal for changing the angular position of the jet pipe is provided which is effective to produce a magnified linear piston displacement by varying the relative amounts of fluid supplied to the input orifices. Shoes supported by the piston rod slide over ports in a plate surface in another chamber and the ports are opened and closed in accordance with the linear position of the piston. The opening and closing of these ports, in turn, determines the linear displacement of a separate servopiston. A method of operating a two-stage servovalve is disclosed which includes the step of changing the angular position of the jet pipe and producing magnified linear position displacement thereby.

3 Claims, 6 Drawing Figures

SHEAR-TYPE FAIL-FIXED SERVOVALVE

BACKGROUND OF THE INVENTION

This invention relates in general to multi-stage servovalves and in particular to a two-stage, shear-type, fail-fixed servovalve with motion amplification in its second stage and a method for actuating the second stage.

Servovalves are used broadly to interface between an electrical control system and mechanical metering or actuating devices, for example, as engine control equipment in an aircraft flight control system for controlling the fuel flow to a gas turbine in response to an electrical control signal. In the latter case, a control signal typically controls the operation of the servovalve such that the velocity of a servopiston changes with the control signal. The servopiston itself may be mechanically coupled to a fuel metering valve or the like, whose status determines the fuel flow to the engine. In such an arrangement, it is desirable to use a fail-fixed servovalve, i.e., a valve which causes the servopiston to lock in place immediately under certain conditions. In one case, the piston must be locked when a loss of the electrical control signal occurs in order to safeguard against unwanted change in fuel flow to the engine. In another instance, the piston must be locked when the electrical control signal exceeds a predetermined value in either direction in order to prevent unwanted fuel flow change if and when a malfunction occurs in the electrical control system.

In a two-stage electrohydraulic servovalve, a fluid under pressure is used to move a mechanical element, e.g. a spool or a piston. In the second stage, the pressurized fluid is vented to a servopiston chamber in accordance with the position of the mechanical element. One type of currently used two-stage servovalve, e.g. as shown in U.S. Pat. No. 4,227,443, further includes a torque motor in the first stage which moves a jet nozzle in response to an electrical control signal. The nozzle directs the flow of fluid toward a pair of input orifices, each receiving fluid for a separate fluid path. The two fluid paths terminate at opposite ends of a common bore in a housing. A spool is movably disposed in the bore such that the spool's position is controlled by the relative flow of fluid through the two fluid paths. A feedback spring has one end attached to the spool and the other end affixed to the nozzle. The spring repositions the jet pipe when the spool attains a position corresponding to the reference value of the control signal. The spool has a plurality of relieved areas interspaced with a plurality of lands. The housing contains passages which communicate between the bore and a high pressure fluid reservoir and a low pressure fluid sump respectively, and between the bore and opposite ends of a servopiston chamber. A servopiston, movably disposed within a servopiston chamber, is actuated by pressurized fluid vented through the aforesaid passages as the spool moves within the bore of the housing opening and closing the passages.

servovalve with either a DC control signal or a pulse width modulated control signal, provided the latter's frequency is high enough so that the torque motor, in the first stage, does not respond to each individual waveform applied to its inputs. Thus, a DC control signal of one-half of the maximum rated current applied to the first stage actuates that stage in a similar fashion as a pulse width modulated control signal which has an average value of one-half of the rated current if the frequency of the latter signal is high enough. The displacement and actual position of the spool, in the above-noted patent, is normally directly proportional to the time average torque motor current from a null or reference current. A detailed description of this spool-type servovalve appears in U.S. Pat. No. 4,227,443, which is assigned to the assignee herein and is incorporated herein by reference.

The spool-type servovalve, as described above, requires a spool which is closely fitted to the bore of the housing to prevent significant leakage around the spool when the spool blocks the passages between the high and low pressure reservoirs and the servopiston chamber. Even with a close fit, the rate at which fluid seeps between the spool and the bore is not constant. Therefore when the spool closes the passages leading to the servopiston chamber, the leakage around the spool causes the servopiston to move slightly or creep at a rate which is difficult to predict or to maintain constant. When the spool and bore wear with use, the creep is even more difficult to determine. The requirement for a close fit makes the spool-type servovalve costly to manufacture since the spool must be machined to fit the bore precisely. Spool-type servovalves are also vulnerable to contaminant material, such as grit in the fluid supply, which is capable of jamming the spool in the bore.

Electrohydraulic two-stage servovalves currently in use in aircraft flight control systems commonly operate in a closed system at hydraulic supply pressures on the order of 3,000 psi. In a closed system, the hydraulic fluid, usually oil, is recirculated and fine-filtered. Since the fluid is exposed to very few elements external to the system, few external contaminants are introduced into the system and the amount of grit, or similar contaminate material in the fluid which may affect the operation of the servovalve, can be kept to a minimum.

In an engine control system, the engine fuel itself is preferably used as the hydraulic fluid. Such a system is by necessity an open system and hence fine-filtering requires large or multiple filters or frequent filter element replacement. An engine control system of this type should therefore be tolerant of comparatively large amounts of contaminant. Further, such a control system normally operates at a lower pressure, i.e., in the range from 200 to 1,000 psi. Hence, the servovalves of such a control system have smaller second stage force levels or contaminant shearing force levels than those of a high pressure system, unless the spools are made larger.

OBJECTS OF THE INVENTION

It is an object of the present invention to provide an improved servovalve.

It is another object of the present invention to provide a shear-type, fail-fixed servovalve which is relatively tolerant of contaminant material.

It is a further object of this invention to provide a shear-type, fail-fixed servovalve which has a high second stage force and which responds quickly to a change of the control signal.

It is still another object of this invention to provide a shear-type, fail-fixed servovalve which has relatively less leakage in its fail-fixed position than prior art spool-type, fail-fixed servovalves.

It is still a further object of this invention to provide a shear-type, fail-fixed servovalve which is capable of being precisely adjusted at various positions and which has enhanced reliability over comparable prior art servovalves.

It is another object of this invention to eliminate the feedback spring used in conventional shear-type servovalves by causing the piston in the second stage of the servovalve to respond to the movement of the jet pipe in either direction from the null position.

It is an additional object of this invention to provide a shear-type, fail-fixed servovalve which is simpler and less costly to manufacture than conventional spool-type servovalves.

These and other objects of the invention, together with the features and advantages thereof will become apparent from the following detailed specification when considered with the accompanying drawings.

SUMMARY OF THE INVENTION

The shear-type servovalve in accordance with the principles of this invention includes a piston having a piston head linearly and movably positioned in one chamber and a piston rod connected thereto. The piston rod extends into at least one other chamber and is linearly movable therein along its axis which is substantially parallel to a planar surface defining in part the last recited chamber. Two passages extend through the piston and communicate with said one chamber on opposite sides of the piston head. Each passage includes an input orifice at one end of the piston rod. An angularly movable jet of fluid is directed at the input orifices. The jet has a null angular position disposed at a predetermined offset angle with respect to said axis at which fluid is supplied, in predetermined relative amounts, to the input orifices. Means responsive to a selectively variable control signal for changing the angular position of the jet is effective to produce a magnified linear piston displacement by varying the relative amounts of fluid supplied to the input orifices. At least one shoe is supported on the piston rod. Means may be included for yieldingly urging the shoe against the plate surface. Ports in the plate surface are adapted to be opened and closed by the shoe in accordance with the linear position of the piston.

A method of actuating the piston in the second stage of the two-stage servovalve includes the step of providing an angularly movable jet of fluid. The jet has a null angular position at a predetermined offset angle with respect to the axis of the linearly movable piston. The method further includes the step of changing the angular position of the jet in response to a control signal which produces a magnified linear piston motion in the second stage.

DETAILED DESCRIPTION OF THE INVENTION

Figure 1:
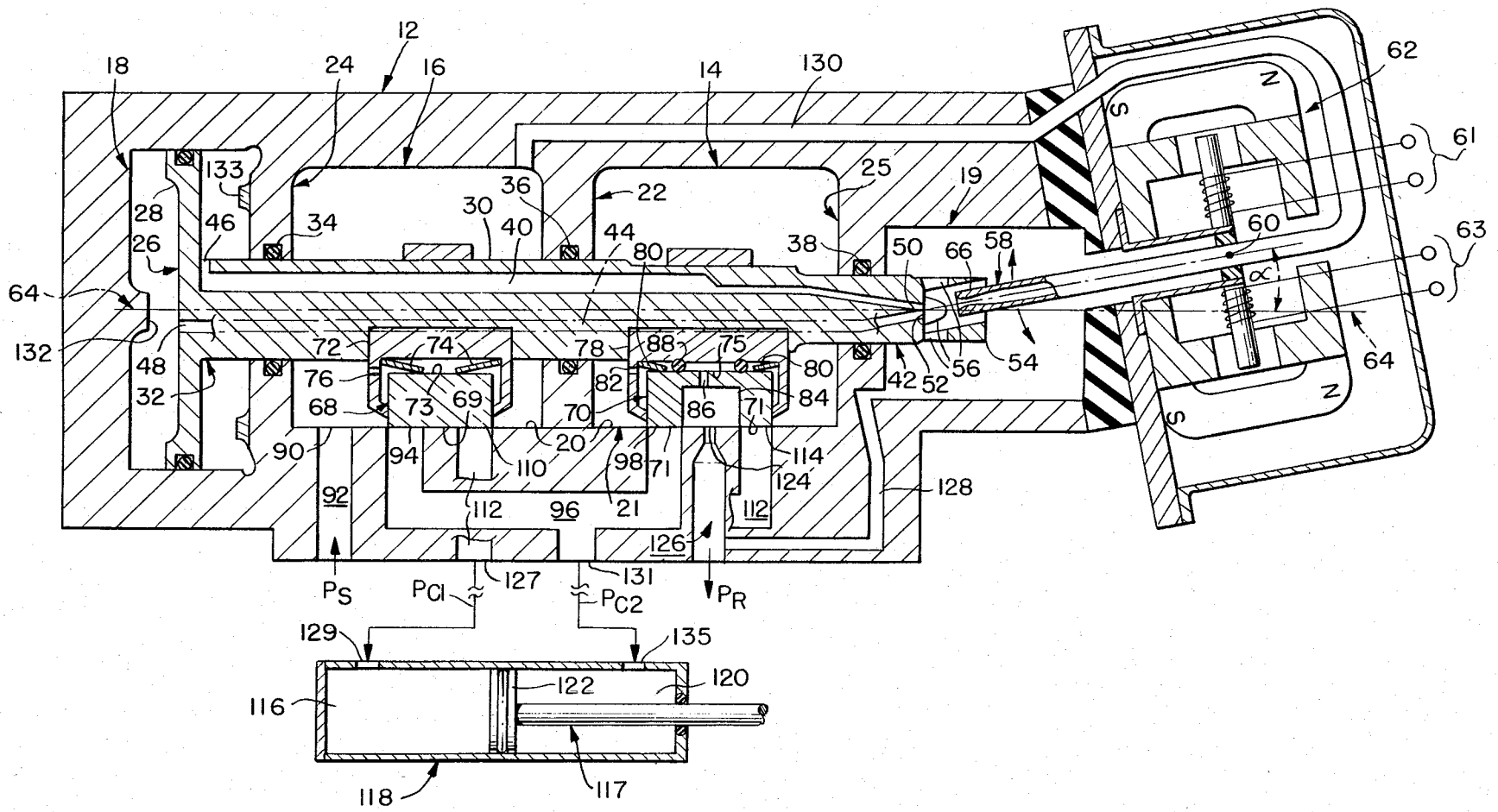
FIG. 1 is a cross-sectional view of a servovalve in a first operational mode.

Referring now to the drawings, FIG. 1 illustrates a preferred embodiment of the invention. The servovalve shown includes a housing 12, having a first chamber 14, a second chamber 16, a third chamber 18 and a fourth chamber 19 with chambers 14 and 16 intermediate chambers 18 and 19. Chambers 14 and 16 are defined in part by a substantially planar surface 20 of a plate or plate portion 21, which is part of housing 12, and by chamber walls 22, 24 and 25 normal to the surface 20. A piston 26 includes piston head 28, which is linearly moveable along its axis 64 within chamber 18. A piston rod 30 is affixed to piston head 28. Piston rod 30 extends through chambers 14 and 16, substantially parallel to surface 20 and slidably engages chamber walls 24, 22 and 25 in a fluid-sealing relationship. The seal may be provided by O-rings positioned in grooves 34, 36 and 38 located in chamber walls 24, 22 and 25 respectively.

A first internal fluid passage or receiver tube 40 extends through piston rod 30 between one end 42 and the other end 32 of the piston rod. A second internal fluid passage or receiver tube 44 similarly extends through piston rod 30 between opposite ends thereof. Each fluid passage 40 and 44 has corresponding input and output orifices. A first output orifice 46, communicates between first fluid passage 40 and chamber 18, to one side of piston head 28. A second output orifice 48 communicates between second fluid passage 44 and chamber 18 on the opposite side of piston head 28. First and second input orifices 50 and 52, corresponding to fluid passages 40 and 44 respectively, are positioned proximate each other at piston rod end 42 and are disposed in a chamber 19. A shroud 54, which includes circumferentialy spaced, radial passages 56, extends from piston rod end 42 into chamber 19.

A jet pipe 58 is adapted to receive a flow of pressurized fluid from a fluid supply passageway 130 which communicates with a high-pressure fluid supply reservoir, the latter being omitted in FIG. 1. The jet pipe is supported at a pivot point 60 such that it can be angularly moved to direct a jet of fluid through its nozzle 66 at the first and second input orifices 50, 52 and thereby vary the relative amounts of fluid supplied to the latter. In the first stage, a conventional torque motor 62, or the like, is provided for angularly positioning jet pipe 58 and is adapted to respond to a selectively variable control signal applied at terminals 61 and 63. Thus, jet pipe 58 is adapted to be turned through an angle proportional to a current applied to terminals 61, 63. The control signal may be DC or pulse width modulated as described in the background of the invention.

FIG. 1 illustrates jet pipe 58 in its position wherein it is disposed at a predetermined angle with respect to the axis 64 of piston head 28 and piston rod 30. In this null position, nozzle 66 is adapted to provide fluid in predetermined relative amounts to input orifices 50 and 52. In the aforementioned position, the relative amounts of fluid passing through passages 40 and 44 produce balanced forces on opposite sides of piston head 28, such that piston 26 remains stationary in the position shown in FIG. 1. Shroud 54, into which nozzle 66 extends, is adapted to limit the movement of the nozzle and hence the angular movement of the jet pipe. Shroud 54 further functions to contain the fluid sprayed from nozzle 66 and to direct the major portion of the fluid flow to the two input orifices. When the jet pipe assumes a first or a second extreme angular position in response to a maximum rated control signal or a minimum rated control signal respectively, shroud 54 limits the jet pipe motion so that the jet is directed substantially toward one input orifice and prevents the jet of fluid from fanning out significantly before the fluid reaches input orifices 50, 52. Radial passages 56 in shroud 54 allow fluid that does not enter input orifices 50, 52 to enter chamber 19. The shroud therefore increases the recovered pressure especially when the jet pipe nozzle is at the maximum distance from input orifices 50, 52.

In the second stage, first and second shoes 70 and 68 are carried by piston rod 30 by a pair of supports 78 and 72 respectively. Shoes 68 and 70 are disposed in chambers 16 and 14 respectively. Supports 72 and 78 are affixed to piston rod 30 and maintain the axial position of the shoes relative to the piston head and the piston rod. Set screws or other means, not shown herein, for adjusting the axial position of shoes 68 and 70 may be incorporated within supports 72 and 78 respectively.

Shoes 68, 70 include first surfaces 69, 71, respectively and second surfaces 73, 75, opposite said first shoe surfaces. A pair of leaf springs 74 is interposed between piston rod 30 and shoe surface 73 and yieldingly urges the shoe surface 69 into contact with plate surface 20. Support 72 includes a vent 76 adapted to communicate with chamber 16. Alternatively, such communication may occur by way of a bore through piston rod 30. Another pair of leaf springs 80 is interposed between piston rod 30 and shoe surface 75 and yieldingly urges shoe surfaces 71 into contact with plate surface 20. A vent 82 communicates with chamber 14. Vent 82 may be replaced by a bore through piston rod 30, as explained above. Shoe 70 has an internal bore 84 therein and a smaller bore 86 therethrough. The smaller bore 86 is adapted to provide communication from shoe surface 75 of shoe 70 to bore 84. A preselected area of surface 75 is isolated from the fluid in chamber 14 by an O-ring 88 set in a pair of grooves disposed in surface 75 and piston rod 30. The purpose of this arrangement will become clear from the discussion below.

Plate surface 20 has six ports in the illustrated embodiment of the invention. Chamber 14 has first, second and third ports, 114, 98 and 124 respectively, communicating therewith. Similarly, chamber 16 has first, second and third ports, 110, 94 and 90, respectively communicating therewith. Port 90 is open to chamber 16 and connects the latter to a high-pressure fluid supply PS through fourth passageway 92. Ports 94 and 98 both communicate with second passageway 96. Ports 110 and 114 both communicate with first passageway 112. Passageway 112 is adapted to communicate with a servopiston chamber 118 through means including a pair of ports 127, 129 in housing 12 and in said servopiston chamber respectively, and specifically with a first portion 116 of chamber 118 positioned to one side of servopiston head 122. Passageway 96 is adapted to communicate with other portion 120 or the second portion of servopiston chamber 118 through means including a pair of ports 131, 135 in housing 12 and in said servopiston chamber respectively, the second portion being on the opposite side of servopiston head 122. The pressures on opposite sides of head 122 are designated $P_{C1}$, $P_{C2}$ respectively. Servopiston head 122 is movably disposed within chamber 118 and responds to varying flows of fluid to the chamber and/or changing pressures $P_{C1}$ and $P_{C2}$. Its piston rod may actuate a fuel metering device or other apparatus, not shown in FIG. 1.

Port 124 communicates with a low pressure fluid sump $P_R$ through a third passageway 126. A return fluid path 128 communicates with chamber 19 and passageway 126. A fluid supply passageway 130 communicates with chamber 16 to supply the jet pipe 58 with high pressure fluid.

As an example of the operation of the servovalve described herein, the null position of jet pipe 58 shown in FIG. 1 corresponds to an electrical control signal equal to 50% of the maximum rated control signal. In the null position, input orifices 50 and 52 receive predetermined relative amounts of the fluid emitted by nozzle 66 and each creates a force on piston head 28. When the forces acting on opposite sides of piston head 28 are in balance, the piston remains stationary. In this piston position, which corresponds to the null position of jet pipe 58, predetermined ports 94, 110, 98 and 114 are closed by shoes 68 and 70 so that substantially all fluid flow to or from servopiston chamber 118 is blocked. As described hereinabove, the position of shoes 68, 70 may be precisely adjusted over the ports by appropriate adjusting means in supports 72 and 78. Therefore, the position of the shoes may be changed to reduce leakage around the shoes between each of chambers 14 and 16 and passages 96, 112 when the piston is in the aforementioned piston position. If the means for adjusting is incorporated, the manufacture and assembly of the shoes, supports and piston rod is simplified and these parts do not have to meet the close tolerances required in prior art servovalves. These factors are reflected in lower production costs.

Chamber 16 is filled with fluid at a pressure which approaches that of high-pressure supply $P_S$. In operation, chamber 14 is also filled with a fluid under pressure and, as will be described hereinafter, the pressure in that chamber is substantially equal either to $P_{C1}$ or $P_{C2}$, depending on the position of piston head 28, piston 26 and thus of shoes 68 and 70. By virtue of vents 76 and 82, pressurized fluid is applied to surfaces 73 and 75 of shoes 68 and 70 respectively. This pressure urges shoes 68 and 70 against plate surface 20 and thus enhances the seal with surface 20. The pressure loading of shoes 68 and 70 is counterbalanced by the pressures $P_{C1}$ and $P_{C2}$ in passageways 112 and 96 respectively, which act on surfaces 69 and 71 of those shoes.

Passageway 126 communicates with low pressure reservoir $P_R$. Therefore, the presure loading of shoe 70 is normally greater than that of shoe 68 because the pressure in passageway 126 does not provide enough counteracting force to the pressure in chamber 14 which is applied to surface 75 of shoe 70 through vent 82. To limit the force urging shoe 70 toward plate surface 20, the area of surface 75 which is exposed to the pressure in chamber 14 is limited by O-ring 88. Thus, the area inside the O-ring is not subject to the pressure applied to the area of surface 75 external thereto. In order to create a low pressure inside O-ring 88, a small bore 86 communicates with the low pressure region of bore 84 and passageway 126. Leaf springs 74, 80 provide additional forces urging shoe surfaces 69, 71, respectively, into contact with plate surface 20 to insure a minimum pressure for sealing the ports at all times.

It will be clear from the foregoing discussion that shoes 68 and 70 are yieldingly urged against surface 20 with which the shoes make sliding contact. Although the pressure loading of the shoes is sufficient to seal the ports in the piston position shown in FIG. 1, it nevertheless allows the shoes to push aside or ride over grit or other contaminant material that may be introduced into the servovalve by the fluid. This tolerance to contaminants helps prevent the servovalve from jamming, thus making it suitable for use with fuel, which is filtered to normal levels, as the hydraulic fluid in an engine control system.

The angular displacement of jet pipe 58 from its null position is normally proportional to the percentage change of maximum rated control signal that is applied to torque motor 62 through terminals 61, 63. Thus, a 25% change in the maximum rated control signal moves the jet pipe through 25% of its total angular sweep. In accordance with the present invention, the null position of jet pipe 58 is at a predetermined offset angle $\alpha$ with respect to axis 64. This offset angle provides motion amplification for the second stage of the servovalve. For example, in one embodiment of the invention where the jet pipe is at an offset angle $\alpha$ of five degrees (5°) from axis 64 and the tip of nozzle 66 is located one inch (1") from pivot point 60, piston head 28 and piston 26, and thus shoes 68 and 70, will be linearly displaced along axis 64 by $\pm 0.125$ inches in response to an angular movement of $\pm 0.7$ degrees of jet pipe 58. In such an arrangement, the motion amplification is approximately 10 to 1, i.e., piston head 28 moves 0.125 inches when the nozzle 66 moves 0.012 inches along its circumferential arc.

Figure 2:
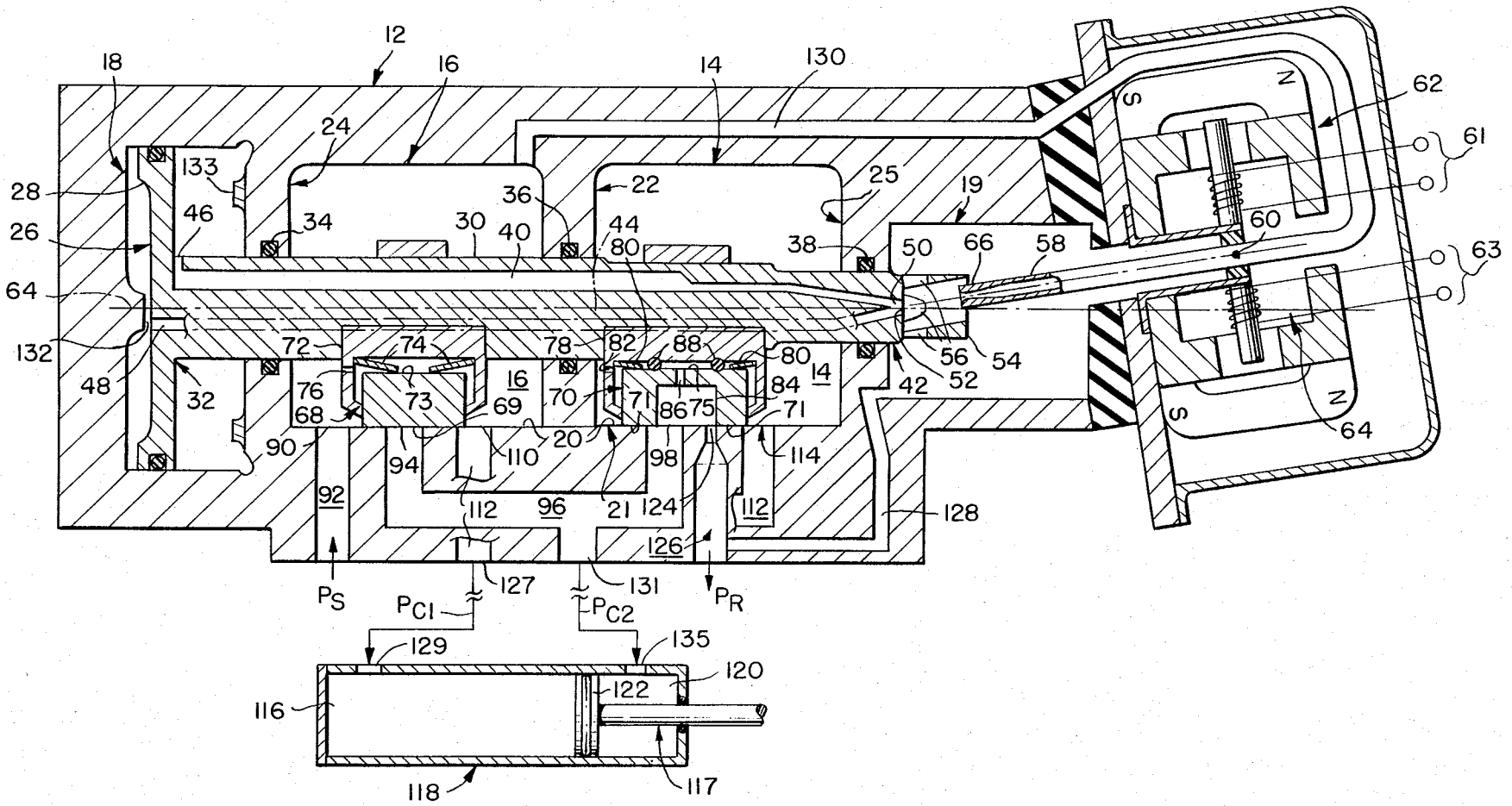
FIG. 2 is a cross-sectional view of the servovalve in another operational mode.

In a conventional arrangement, when the torque motor 62 is impressed with a control signal equal to 25% of the maximum rated control signal, the jet pipe will change its angular position by 25%. Since the null position in the embodiment under discussion corresponds to 50% of maximum rated control signal, 25% of maximum represents a decrease in signal amplitude and causes jet pipe 58 to be angularly displaced in a first direction relative to the null position, e.g. upward, i.e. in a clockwise direction about point 60. This change in angular position will cause relatively more fluid to enter input orifice 50 and passage 40 than is supplied to orifice 52 and passage 44. As the balance on opposite sides of piston head 28 is disturbed, piston 26 is caused to move to the left because of the increased pressure on the rod-side of the piston head and the decreased pressure on the opposite side. Shoes 68 and 70 will likewise slide to the left so as to open predetermined ports 110 and 114. This position is shown in FIG. 2. With port 110 open, there is now communication between chamber 16 and passageway 112, so that pressure $P_{C1}$ will approach supply pressure $P_S$. As consequence, the pressure in portion 116 of servopiston chamber 118 likewise approaches $P_S$.

Simultaneously, shoe 70 opens port 114 and hence the pressure in chamber 14 will approach supply pressure $P_S$. Shoe 70 also opens port 98 and thus communication is provided between portion 120 of servopiston chamber 118, passage 96, port 98, bore 84, port 124 and passageway 126 to low pressure fluid sump $P_R$. In this position of piston 26, pressure $P_{C2}$ becomes substantially equal to PR The result of the above-described operation is to raise the pressure in portion 116 of servopiston chamber 118 and simultaneously lower the pressure in portion 120. Hence, servopiston 117 is caused to move to the right.

Figure 3:
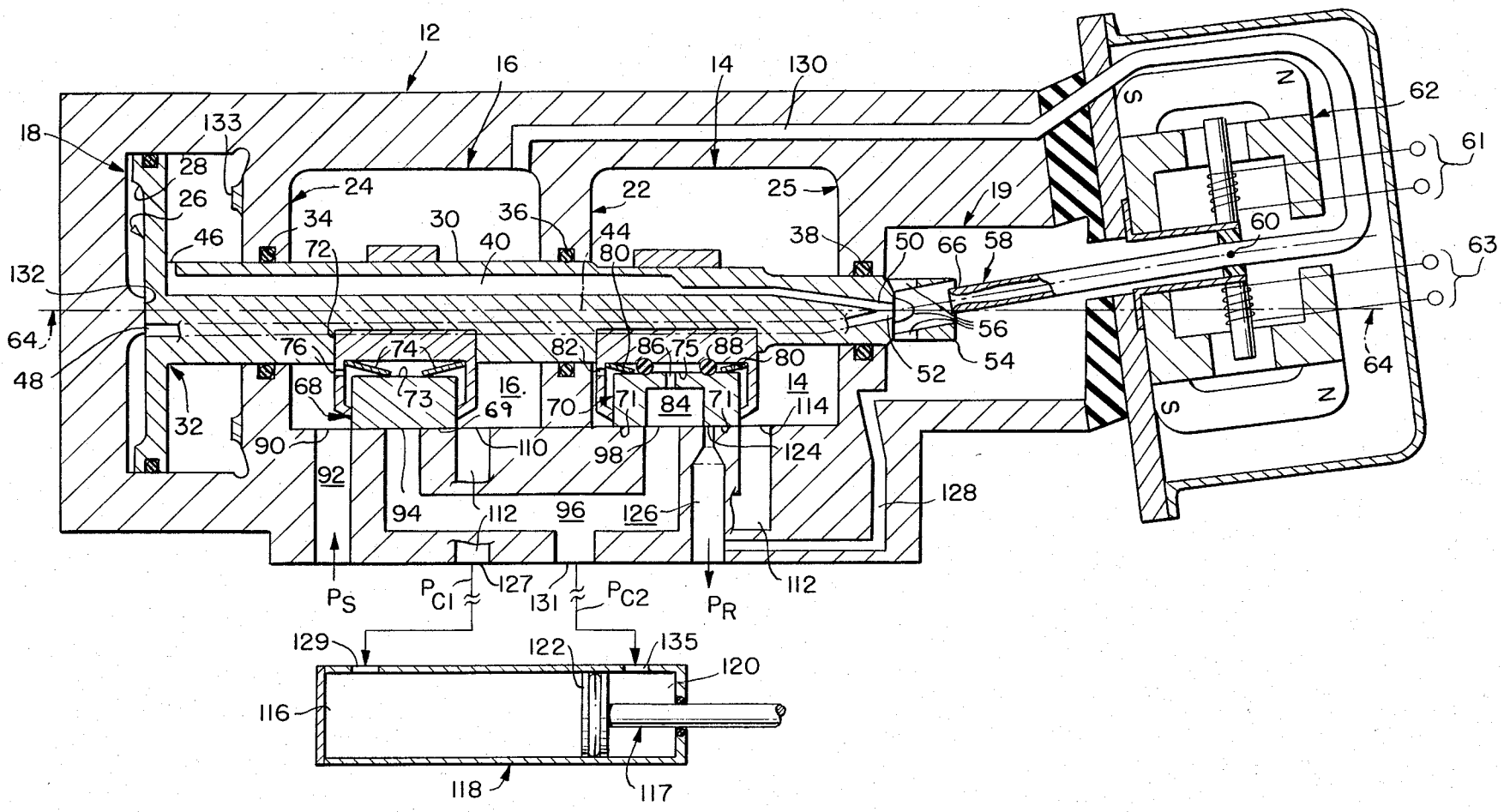
FIG. 3 is a cross-sectional view of the servovalve in still another operational mode.

When the control signal applied to torque motor 62 drops to 0% of the maximum rated control signal, jet pipe 58 will angularly move still further upward, until nozzle 66 is in close proximity to shroud 54. As previously explained, shroud 54 limits the total angular movement of the jet pipe and thereby insures that even in the extreme clockwise positon of the jet pipe, a substantial amount of the fluid emitted by nozzle 66 will be received by orifice 50. Piston 26 is now caused to move to the left against stop 132, as shown in FIG. 3. At this point, port 110 is completely uncovered by shoe 68. Accordingly, pressure $P_S$ is vented through passageway 112 and pressure $P_{C1}$ will approximate pressure $P_S$. Shoe 68 continues to block port 94 and shoe 70 is now blocking predetermined port 124. Hence, passageway 96 is now isolated from chamber 14 and passageway 126 and no hydraulic fluid is allowed to escape therefrom. Pressure $P_{C2}$ will increase to a value approximately equal to $P_S$ to balance the forces acting on opposite sides of servopiston head 122. However, relatively little fluid flows from portion 120 of servopiston chamber 118 and consequently servopiston 117 is locked in place. Stated differently, when pressure $P_{C2}$ is isolated, it increases in value to balance the forces on head 122 developed by $P_{C1}$ but the servopiston remains stationary because the fluid is relatively incompressible and fluid flow is blocked from portion 120. There is some leakage in the valve under shoes 68, 70. This leakage causes servopiston 117 to creep, i.e., to move very slowly. In the present invention, such creep occurs at a relatively slow rate compared with prior art servovalves because of the configuration of the shoes and the cooperation between the shoes, the plate surface and the ports.

In the one specific embodiment of the invention, the locking of servopiston 122, i.e., the point at which shoe 70 has closed port 124, occurs at approximately 12.5% of the maximum rated control signal. For all signals less than this 12.5% current, the servopiston is locked in place and thus provides the aforementioned fail-fixed action.

When the control signal returns to 50% maximum rated control signal from 0%, jet pipe 58 swings downward, i.e. in a counterclockwise direction. Piston 26 responds to this change in angular position by moving to the right due to the varied relative amounts of fluid supplied to opposite sides of the piston head. Hence, the piston in the present invention responds to the movement of the jet pipe without the necessity of return springs. Likewise, shoes 68 and 70 will again pass through the position shown in FIG. 2. Hence, hydraulic fluid is vented to chamber portion 116 and vented away from chamber portion 120. Portions 116 and 120 of servopiston chamber 118 again are affected by this flow and pressure change and, as a result, servopiston 117 moves to the right. When the control signal reaches 50% of maximum rated value, jet pipe 58 again assumes its null position and piston 26 assumes the position illustrated in FIG. 1. Since shoes 68 and 70 again block ports 94, 110, 98 and 114, pressures $P_{C1}$ and $P_C2$ are approximately equal to each other and since the flow is blocked by the shoes, the servopiston remains stationary.

A detailed description of the actuation of the servopiston with respect to the opening and closing of the ports is provided in U.S. Pat. No. 4,227,443 which is incorporated herein by reference.

Figure 4:
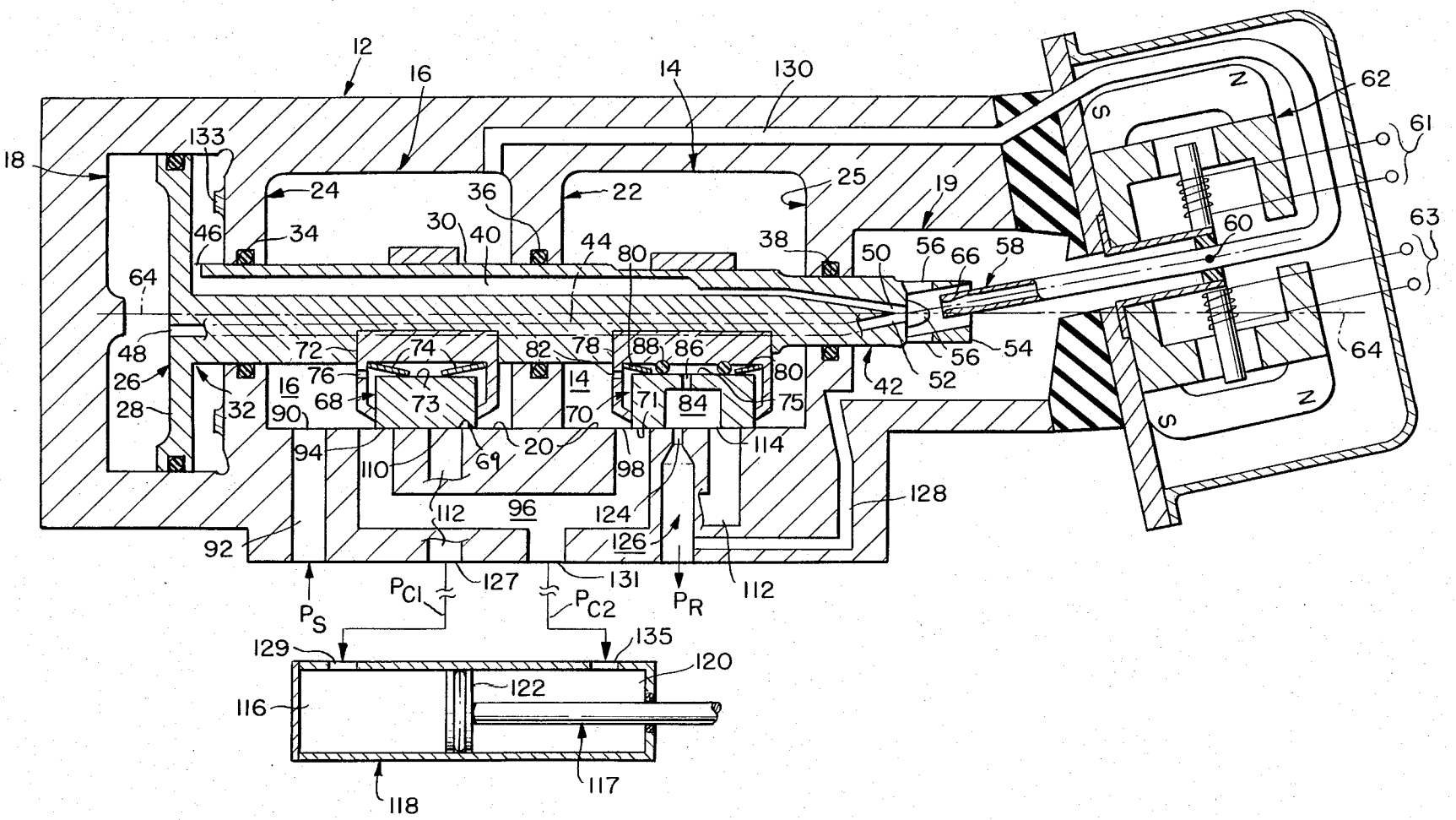
FIG. 4 is a cross-sectional view of the servovalve in a further operational mode.
Figure 5:
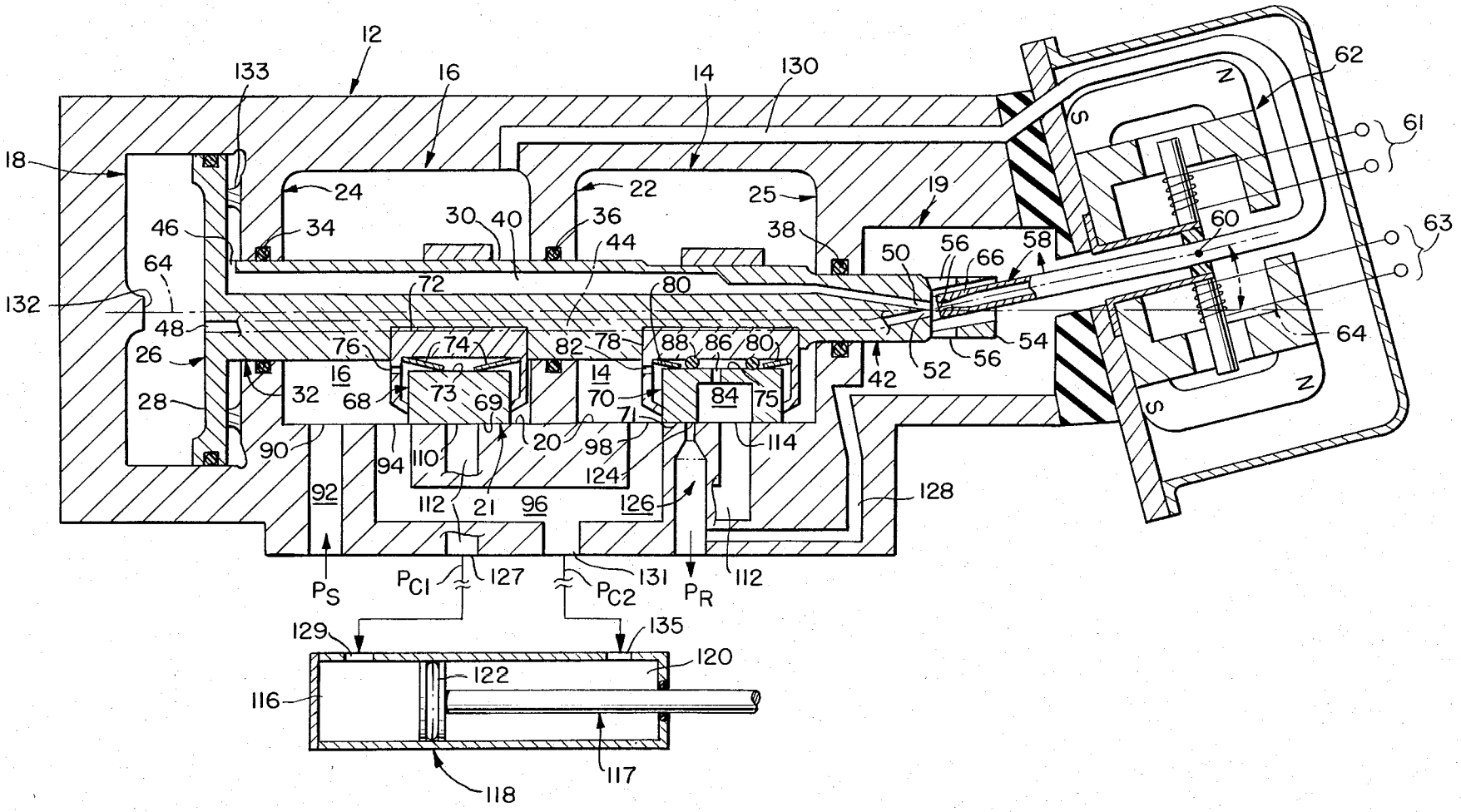
FIG. 5 is a cross-sectional view of the servovalve in still a further operational mode.

When a control signal equal to 75% of the maximum rated value is impressed on torque motor 62, jet pipe 58 angularly moves in a counterclockwise direction from the null position shown in FIG. 1. More fluid is now directed at input orifice 52, which results in an imbalance of forces acting on piston head 28. Accordingly, piston head 28 and piston 26 are now caused to move to the right. As shoes 68 and 70 move to the right, shoe 68 opens predetermined port 94 and admits fluid at the high pressure $P_S$ to passageway 96. Hence, pressure $P_{C2}$ now approaches $P_S$. Simultaneously, shoe 70 opens port 114. Thus pressure $P_{C1}$ in portion 116 of servopiston chamber 118 is vented to low pressure sump $P_R$. The position of piston 26 and shoes 68, 70 for this situation is illustrated in FIG. 4. Servopiston 117 is now caused to move to the left due to the flow of hydraulic fluid in passages 96 and 112 and the pressure differential between $P_{C2}$ and $P_{C1}$. When the control signal is equal to 100% of the maximum rated value, jet pipe 58 reaches its extreme counterclockwise displacement from the null position and nozzle 66 is now in close proximity to shroud 54. The action causes piston 26 to move further to the right until piston head 28 butts stop 133 or some other suitable stop, as shown in FIG. 5. In this position, port 94 is uncovered by shoe 68 and, as a consequence, pressure $P_{C2}$ substantially equals $P_S$. Simultaneously, shoe 68 blocks port 110 and shoe 70 now blocks predetermined port 124 which communicates with low pressure sump $P_R$. Thus passageway 112, which communicates with portion 116 of servopiston chamber 118, is sealed off. Therefore, servopiston 117 is locked in place because the hydraulic fluid flow is blocked. This is the other fail-fixed position and it corresponds to a control signal which exceed a predetermined value. For the example under consideration, the predetermined value is 87.5% of maximum rated control signal.

Figure 6:
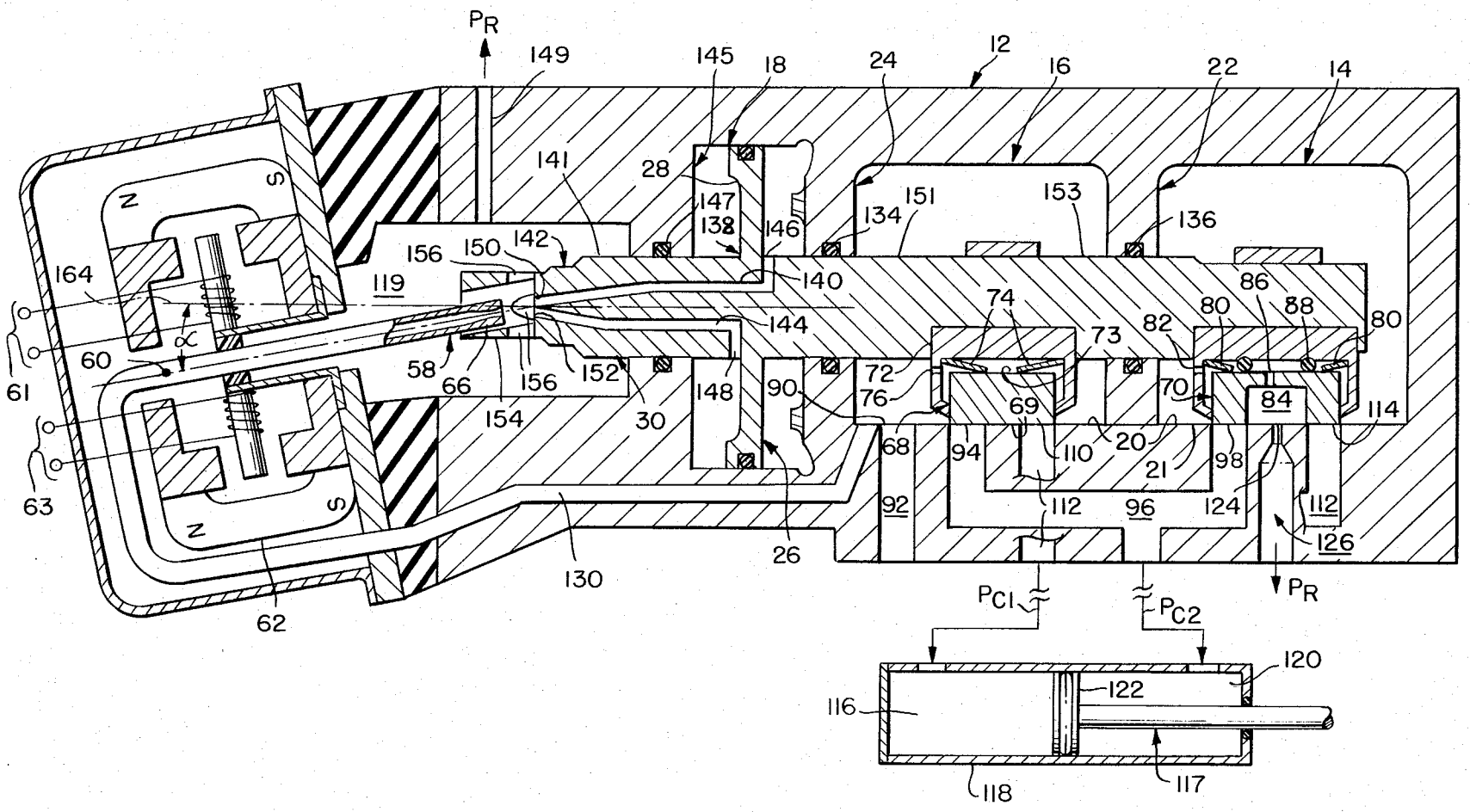
FIG. 6 is a cross-sectional view of another embodiment of a servovalve in accordance with the principles of the invention.

FIG. 6 illustrates another embodiment of the present invention in which corresponding reference numerals have been carried forward. Chambers 18 and 16 are intermediate chamber 14 and an additional fourth chamber 119. A piston 26 includes piston head 28 and piston rod 30 includes left-hand and right-hand extensions 141 and 151 respectively, as well as passages 140 and 144 which terminate in output orifices 146 and 148 respectively, on opposite sides of piston head 28. Piston head 28 is moveably disposed in chamber 18 along axis 164 of the piston head and the piston rod. The left-hand extension 141 of the piston rod extends into a fourth chamber 119 and slideably engages chamber wall 145. An O-ring set in a groove 147 in chamber wall 145 provides a fluid-tight seal. End 142 of piston rod extension 141 is located in chamber 119 and includes a pair of input orifices 150 and 152 corresponding to passages 140 and 144, respectively. A shroud 154, which includes circumferentialy spaced, radial passages 156, extends from end 142 of piston rod extension 141. A vent 149 is adapted to communicate between the low pressure fluid sump $P_R$ and chamber 119.

The right-hand extension 151 of piston rod 30 extends through chamber 16 and into chamber 14 and it slideably engages chamber walls 24 and 22. O-rings set in grooves 134 and 136 respectively provide a fluid seal with walls 24 and 22. Piston rod extension 151 includes a section 153 which is substantially parallel to plate surface 20 and which supports shoes 68 and 70, in chambers 16 and 14 respectively. The operation of the servovalve shown in FIG. 6 is similar to that of FIG. 1, except that the jet pipe 58 moves in a counterclockwise in response to a control signal which is equal to 25% of the maximum rated control signal. Conversely, jet pipe 58 moves clockwise in response to a control signal which is equal to 75% of the maximum rated control signal. However, piston head 28, and therefore piston rod 30 and extensions 141 and 151, move to the left when a control signal equal to 25% of the maximum rated control signal is applied to torque motor 62.

Although extension 151 is shown to be coaxial with piston axis 164, it will be understood that the invention is not so limited. For example, if the structure of housing 12 so dictates, extension 151 may take the shape of a dog leg, provided only that shoes 68 and 70 move in a direction parallel to plate surface 20.

A similar structural variation is possible for piston rod extension 141, provided only that jet pipe 58 has a null position disposed at a predetermined offset angle with respect to the axis 164 of the piston rod.

The servovalve in accordance with the present invention is capable of handling various supply pressures $P_S$. This is true even though the frictional forces which resist the movement of shoes 68, 70 increase with increasingly higher supply pressures $P_S$. To compensate for the added frictional drag on shoes 68 and 70, the force applied to piston 26 may be increased by enlarging the area of piston head 28. Since the size of piston head 28 in the second stage of the servovalve is relatively independent of the size of all other elements, i.e. of the piston rod, shoes, etc., the force required to move shoes 68, 70 can be developed without significant design modifications.

The servovalve, in accordance with the present invention, could be constructed with chambers 14 and 16 combined as one chamber. In this embodiment, internal passages through shoes 68 and 70 and rod 30 would allow communication between passages 96 and 112 and the high and low pressure reservoirs. Another variation of this latter embodiment would utilize a single shoe yieldably supported by rod 30.

Various dimensional combinations are possible in the servovalve which constitutes the subject matter of the present invention. In one embodiment of the invention, nozzle 66 is preferably spaced a maximum of five inside diameter nozzle lengths from input orifices 50, 52 when the piston head 28 abuts shoulder 132. Ports 94, 110, 98 and 114 are rectangular in shape, having a length of approximately 0.100 inches of stroke relative to piston 26, by 0.190 inches wide for an 8 gallon per minute servovalve. Port 124, which leads to the sump by way of passageway 126, consists of a long slot, approximately 0.025 inches of piston stroke by 0.760 inches wide. Piston head 28 has an area of approximately 1.25 square inches. These dimensions provide fail-fixed action for approximately 12.5% of the stroke of the piston 26 at each end of travel, as described hereinabove. Specifically, in such an embodiment the valve is fail-fixed or locked for control signals below 12.5% of the maximum rate value and for control signals exceeding 87.5% maximum rated value.

The invention herein is not limited to the particular embodiment disclosed. For example, the shear-type fail-fixed servovalve may be modified by including a spring which moves piston 26 in a specified direction upon the loss of the supply pressure $P_S$. Further, piston head 28 need not be fixedly or directly connected to piston rod 30. For example, the connection may be by means of gear and flexible receiver tubes may be substituted for passages 40 and 44. Other mechanical connections will now become apparent to those skilled in the art. The predetermined offset angle $\alpha$ may be changed where a different motion amplification factor is desired. Further, an adjustment mechanism may be incorporated for variably adjusting the offset angle. Additionally, the means for yieldingly urging shoes 68, 70 may be modified by excluding leaf springs 74, 80 from one or both shoes, by omitting O-ring 88, or by any combination thereof.

The dimensions of shoes 68, 70 and ports 94, 110, 98, 114 and 124 may be varied to provide for different responses by servopiston 117. The location of ports 90, 92, 98, 110, 114 and 124 in surface 20 may be varied in order to provide different responses by servopiston 117. One shoe may have a plurality of passages extending therethrough which are adapted to communicate with one or more predetermined ports. Surfaces 69, 71 of the shoes may conform to a curved plate surface 20 and be modified to closely fit the curvature of the latter surface. The conforming curved surfaces may provide for better sealing of chambers 14 and 16 from passages 96, 112 and 126. Torque motor 62 may be replaced by any means which varies the angular position of jet pipe 58 in response to a control signal.

Thus, from the foregoing discussion it will be clear that the present invention is not limited to the apparatus and method specifically disclosed herein, but that numerous variations, modifications, partial and complete substitutions, equivalents and changes will now occur to those skilled in the art, all of which fall within the scope of the disclosed invention. Accordingly, it is intended that the invention disclosed herein be limited only by the spirit and scope of the appended claims.

What is claimed is:

1. A servovalve comprising:

a housing including a plurality of chambers, a plate, a first and a second one of said chambers being defined in part by a substantially planar surface of said plate and by chamber walls normal to said surface, said housing including a plurality of passageways, each adapted to pass fluid therethrough, a first one of said passageways communicating between said first and second chambers through a first port in each of said last-recited chambers, a second passageway communicating between said first and second chambers through a second port in each of said last-recited chambers, a third passageway communicating between a low pressure fluid sump and said first chamber through a third port in said first chamber, a fourth passageway communicating between a high pressure fluid supply and said second chamber through a third port in said second chamber;

a piston including a piston head connected to a piston rod, said piston being movable along its axis in a direction substantially parallel to said platc surface, said piston head being disposed in a third one of said chambers, said piston rod extending into each of said plurality of chambers and engaging said chamber walls in slideably sealing relationship;

at least a portion of said piston rod including first and second internal passages extending between first input and output orifices and second input and output orifices respectively, said first and second output orifices communicating with said third chamber on opposite sides of said piston head, said first and second input orifices being positioned proximate each other at one end of said piston rod disposed in a fourth one of said chambers;

a shroud extending from said one end of said piston rod within said fourth chamber;

an angularly moveable jet pipe extending into said shroud from outside said fourth chamber and terminating in a nozzle spaced from said first and second input orifices, said nozzle being adapted to direct a jet of fluid at said input orifices, said jet pipe having a null angular position in which said jet pipe assumes a predetermined offset angle with respect to said piston axis, whereby fluid is supplied in predetermined relative amounts to said first and second input orifices;

means responsive to a selectively variable control signal for changing the angular position of said jet pipe, the angular displacement of said jet pipe relative to said null position being effective to produce a magnified linear piston displacement along said axis by varying the relative amounts of fluid supplied to said first and second input orifices;

first and second shoes supported by said piston rod and disposed in said first and second chambers respectively, each shoe including a first shoe surface adapted to make sliding contact with said plate surface and a second shoe surface opposite said first shoe surface;

means for yieldingly urging said first shoe surface against said plate surface, said urging means including means for admitting pressurized fluid effective to exert a force on each of said second shoe surfaces, said urging means further including spring means interposed between said piston rod and each of said second shoe surfaces;

a plurality of ports in said plate surface, predetermined ones of said ports being adapted to be opened and closed by said shoes upon the occurrence of said linear piston displacement;

a servopiston chamber;

a servopiston movably disposed in said servopiston chamber, said servopiston including a servopiston head which divides said last-recited chamber into first and second variable chamber portions, said servopiston further including a servopiston rod affixed to said servopiston head and slidably extending through a wall of said servopiston chamber; and means including a pair of ports in said housing and in said servopiston chamber respectively, for communicating respectively between said first passageway and said first chamber portion and between said second passageway and said second chamber portion;

whereby said servopiston is adapted to move in a linear direction within said servopiston chamber upon the admission of pressurized fluid from said first or second passageway into one of said chamber portions simultaneously with the venting of fluid from the other chamber portion to said low pressure sump.

2. A servovalve in accordance with claim 1 wherein said first and second chambers are positioned intermediate said third and fourth chambers;

said piston rod extending between said third and fourth chambers through said first and second chambers; and said passages extending between said piston head and said one end of said piston rod.

3. A servovalve in accordance with claim 1 wherein said first and second chambers are positioned on one side of said third chamber and said fourth chamber is positioned on the other side of said third chamber;

said piston rod extending between said first and fourth chambers through said second and third chambers; and said passages extending between said piston head and said one end of said piston rod.

* * * * *